US006127081A

United States Patent [19]

Yamauchi

[11] Patent Number: 6,127,081

[45] Date of Patent: Oct. 3, 2000

[54] DEVELOPING AGENT AND IMAGE FORMING APPARATUS

[75] Inventor: Toshiaki Yamauchi, Fujisawa, Japan

[73] Assignees: Toshiba Tec Kabushiki Kaisha, Tokyo; Kabushiki Kaisha Toshiba, Kawasaki, both of Japan

[21] Appl. No.: 09/442,638

[22] Filed: Nov. 18, 1999

[30] Foreign Application Priority Data

Nov. 19, 1998 [JP] Japan ..... 10-329697

[51] Int. Cl.[7] ..... G03G 9/097; G03G 15/22

[52] U.S. Cl. ..... 430/110; 430/111; 399/324

[58] Field of Search ..... 430/110, 111; 399/324

[56] References Cited

U.S. PATENT DOCUMENTS

| | | | |
|---|---|---|---|
| 4,623,605 | 11/1986 | Kato et al. | 430/110 |
| 5,225,303 | 7/1993 | Tomita et al. | 430/110 |
| 5,275,900 | 1/1994 | Ong et al. | 430/110 |
| 5,905,011 | 5/1999 | Kurose et al. | 430/111 |
| 6,001,527 | 12/1999 | Ishihara et al. | 430/111 |

FOREIGN PATENT DOCUMENTS

| | | |
|---|---|---|
| 60-136755 | 7/1985 | Japan . |
| 6-11897 | 1/1994 | Japan . |

*Primary Examiner*—Roland Martin
*Attorney, Agent, or Firm*—Foley & Lardner

[57] ABSTRACT

Disclosed is a developing agent which permits preventing occurrence of offset and spent toner, which permits obtaining a picture image having a sufficiently high image density, which can be used in a fixing device that does not include an oil supply mechanism. The developing agent comprises a coloring agent, a binder containing a polyester resin as a main component, a charge controller consisting of a zirconium complex compound of a salicylic acid derivative, silica subjected to a hydrophobic treatment, and titanium oxide.

17 Claims, 1 Drawing Sheet

DEVELOPING AGENT AND IMAGE FORMING APPARATUS

BACKGROUND OF THE INVENTION

The present invention relates to an image forming apparatus using an electrophotographic technology and a developing agent used in the image forming apparatus.

In a full color electrophotographic process, toners of four colors of cyan (C), magenta (M), yellow (Y) and black (K) are developed and fixed to obtain development of colors including intermediate color tones. In order to obtain a color tone having a high chroma, it is necessary for each toner to have a high transparency. It is also necessary to obtain a uniform fixed surface low in roughness.

In general, polyester resin or the like having a low molecular weight, which is likely to be subjected to a sharp melting, is used as a binder of toner for a full color electrophotography. However, the polyester resin leaves room for further improvement. Specifically, the polyester resin is low in its mechanical strength, tends to generate an offset problem, and is poor in compatibility with wax such as polypropylene (PP) having a low molecular weight or polyethylene (PE) having a low molecular weight. Also, the toner itself for the full color electrophotography is defective in that, since the pigment tends to be charged strongly, it is difficult to obtain a stable image density (ID).

As a measure for overcoming the offset problem in the case of using a colored toner, the thermal fixing roller is coated in general with a large amount of a silicone oil.

FIG. 1 exemplifies a fixing apparatus used in the conventional full color image forming apparatus. As shown in the drawing, the apparatus comprises a heat roller 35, a cleaning roller 4 arranged in contact with the heat roller 35, a means for supplying a silicone oil onto the heat roller 34, and a pressurizing roller 45 arranged to face the heat roller 35 and rotatable in synchronism with rotation of the heat roller 35. The silicone oil supply means comprises an oil coating roller 101 rotatable in synchronism with rotation of the heat roller 35, an oil impregnation tank 8 equipped with an oil impregnation roller 9 that is rotatable in synchronism with rotation of the oil coating roller 101, an oil transfer pipe 7 equipped with an oil transfer pump 6 and connected to the oil impregnation tank 8, an oil supply tank 5 connected to the oil transfer pipe 7 and housing a silicone oil, an oil recovery filter 102 arranged below the pressurizing roller 45, and another oil transfer pipe 103 connected at one end to the oil recovery filter 102 and at the other end to the oil supply tank 5.

In the fixing apparatus of the construction described above, the heat roller 35 can be coated with a large amount of the silicone oil supplied from the oil supply tank 5 via the oil coating roller 101.

However, a complex oil coating mechanism is required in the fixing apparatus shown in FIG. 1, making it necessary to conduct a maintenance operation such as replenishing of oil periodically. What should be noted is that, if the heat roller is abraded by the stress of the oil coating mechanism, the oil is attached to the printed sheet.

Such being the situation, it is proposed in recent years to add a rice wax that permits fixation without using an oil, said fixation being satisfactory in offset resistance, while maintaining a high transparency. However, the toner life is deteriorated in the case of adding a rice wax. Also, in the case of a full color toner, a soft resin is used. As a result, a so-called "spent toner", i.e., the phenomenon that the toner is adhered with time to the carrier and the developing apparatus, tends to take place. If a wax is added, it is made more difficult to prevent a charging capability of the full color toner from being lowered with time.

It is conceivable to add a charge controller, a hydrophobic silica, etc. in order to improve the toner life and fluidity of the toner. However, the charge controller is colored in many cases, and a colorless charge controller is incapable of producing a sufficient effect. Also, if a hydrophobic silica is used in a large amount, the charging amount is increased so as to lower the image density (ID). Further, the charging amount of the hydrophobic silica under a low humidity greatly differs from that under a high humidity, giving rise to additional problems such as fogging and scattering. Still further, even if the hydrophobic silica is used together with an inorganic oxide having a low resistivity such as titanium oxide, the surface resistivity of the toner is lowered. As a result, the charging amount tends to be lowered with time, and the toner scattering tends to take place.

As described above, it is difficult to maintain a sufficient offset resistance, to control the charging of a colored toner, and to prolong the toner life by preventing the occurrence of a spent toner.

BRIEF SUMMARY OF THE INVENTION

A first object of the present invention, which has been achieved in view of the situation described above, is to provide a developing agent that permits sufficiently preventing the occurrence of offset and spent toner, that permits exhibiting a stable charging capability, and that permits obtaining a satisfactory picture image having a sufficiently high image density (ID).

A second object of the present invention is to provide an image forming apparatus that permits preventing occurrence of offset and spent toner without applying a silicone oil to the fixing apparatus and also permits obtaining a satisfactory picture image having a sufficiently high image density (ID).

According to an aspect of the present invention, there is provided a developing agent, comprising a coloring agent, a binder containing a polyester resin as a main component, a charge controller consisting of a zirconium complex compound of a salicylic acid derivative, silica subjected to a hydrophobic treatment, and titanium oxide.

According to another aspect of the present invention, there is provided an image forming apparatus, comprising an image carrier, a developing device housing a developing agent to develop an electrostatic latent image formed on the surface of the image carrier into a visible image formed of the developing agent, the developing agent comprising a coloring agent, a binder containing a polyester resin as a main component, a charge controller consisting of a zirconium complex compound of a salicylic acid derivative, silica subjected to a hydrophobic treatment, and titanium oxide, a transfer device for transferring the visible image formed of the developing agent onto a transfer material, and a fixing device for fixing the visible image to the transfer material.

The present invention makes it possible to obtain a developing agent that sufficiently permits preventing occurrence of offset and spent toner, that exhibits a stable charging capability, and that permits forming a satisfactory picture image having a sufficiently high image density (ID).

It should also be noted that the developing agent of the present invention makes it possible to provide an image forming apparatus that permits sufficiently preventing the occurrence of offset and spent toner without applying a silicone oil to the fixing device and also permits forming a satisfactory picture image having a sufficiently high image density (ID).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
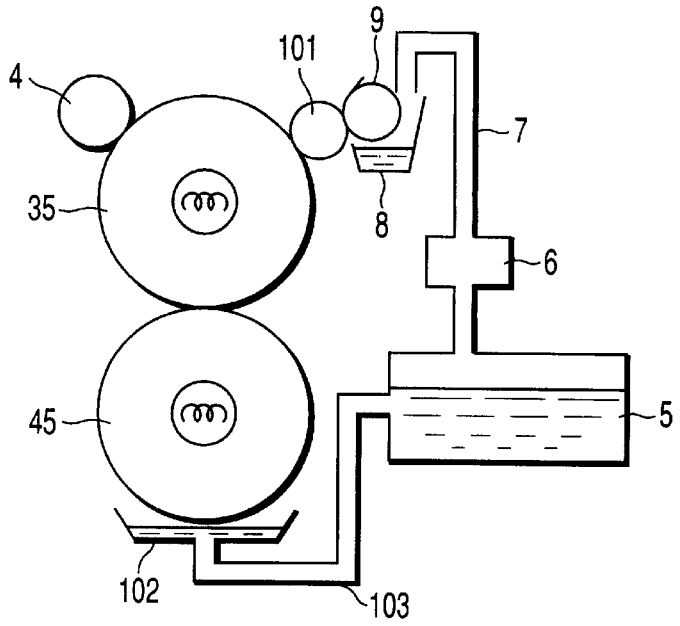
FIG. 1 PRIOR ART
FIG. 1 schematically exemplifies a fixing device used in the conventional full color image forming apparatus.

The present invention provides a developing agent effective for use as, particularly, a color developing agent for forming a color picture image. The developing agent of the present invention comprises a coloring agent, a binder containing a polyester resin as a main component, a charge controller consisting of a zirconium complex compound of a salicylic acid derivative, silica subjected to a hydrophobic treatment, and titanium oxide.

Titanium oxide having a low resistivity is contained in the developing agent of the present invention. Nevertheless, the charging amount of the developing agent is not lowered and a stable charging capability can be obtained regardless of changes in the environment.

In the present invention, additives such as a zirconium complex compound of a salicylic acid derivative, a polyester resin, a hydrophobic silica and titanium oxide are used in combination so as to improve in good balance both the charging capability and life of the developing agent containing a polyester resin and to form a good image while sufficiently preventing occurrence of offset and spent toner.

The present invention also provide an image forming apparatus using the particular developing agent of the present invention. Specifically, the image forming apparatus of the present invention comprises an image carrier, a developing device housing a developing agent to develop an electrostatic latent image formed on the surface of said image carrier into a visible image formed of said developing agent, said developing agent comprising a coloring agent, a binder containing a polyester resin as a main component, a charge controller consisting of a zirconium complex compound of a salicylic acid derivative, silica subjected to a hydrophobic treatment, and titanium oxide, a transfer device for transferring said visible image formed of the developing agent onto a transfer material, and a fixing device for fixing the visible image to said transfer material.

Since the developing agent of the present invention permits improving both the charging capability and life in good balance, the image forming apparatus of the present invention using the particular developing agent is capable of sufficiently preventing the occurrence of offset and spent toner so as to obtain a satisfactory picture image. It should also be noted that, even if a fixing device, which does not include an oil supplying and coating mechanism, is used in the image forming apparatus of the present invention, offset is not generated so as to obtain a good picture image.

A zirconium complex compound of salicylic acid derivative is used in the present invention as a charge controller. It is certainly known to the art that other metal complex compounds such as a zinc complex compound and a boron complex compound are colorless. However, these other metal complex compounds do not exhibit a strong charging capability. For example, if these other metal complex compounds are used together with hydrophobic silica and titanium oxide in an attempt to acquire balance of ID with the fluidity and life, the charging amount is decreased and the scattering of the developing agent is increased.

The zirconium complex compound of a salicylic acid derivative used in the present invention, which is represented by a general formula (1) given below, is colorless and, thus, does not impair the color development performed by the colored toner:

(1)

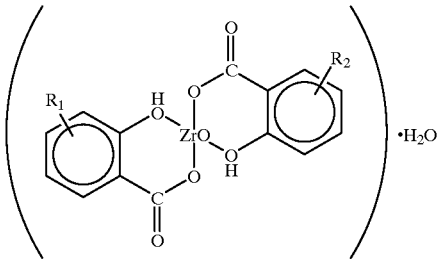

It is desirable to add the zirconium complex compound of a salicylic acid derivative in an amount of 0.2% by weight to 3.0% by weight based on the binder amount. If the addition amount of the zirconium complex compound is smaller than 0.2% by weight, the initial charging amount is small and the charging amount is decreased with time, giving rise to fogging and toner scattering problem. On the other hand, if the addition amount exceeds 3.0% by weight, the initial charging amount is unduly increased and the image density (ID) is rendered insufficient. Further, the zirconium complex compound fails to be dispersed uniformly into the resin. As a result, the toner tends to be adhered to the photosensitive drum so as to bring about problems such as contamination.

It is desirable to add the hydrophobic silica in an amount of 0.2% by weight to 3.0% by weight based on the binder amount. If the addition amount of the hydrophobic silica is smaller than 0.2% by weight, the fluidity of the toner tends to become low so as to bring about problems such as blocking of the toner due to heat, ununiformity of the image, and short life-time. On the other hand, if the addition amount exceeds 3.0% by weight, the charging amount of the toner tends to become too high, thus lowering the image density.

It is desirable to add titanium oxide in an amount of 0.2% by weight to 3.0% by weight based on the binder amount. If the addition amount of titanium oxide is smaller than 0.2% by weight, the initial charging amount of the toner tends to increase, thus lowering the image density. On the other hand, if the addition amount exceeds 3.0% by weight, the charging amount of the toner tends to decrease with time, giving rise to fogging and toner scattering.

The chemical structure of the polyester resin used in the present invention is not particularly limited. It is possible to use the thermoplastic polyester resins widely used in this technical field. The polyester resin used in the present invention represents a resin having as a backbone chain a polymer prepared by an ester condensation between a divalent acid and a divalent alcohol. It is possible to use a saturated or unsaturated monomers for preparation of the polyester resin used in the present invention. Where the monomer used has an unsaturated double bond, it is possible to use a vinyl monomer such as styrene for preparation of a copolymer. However, it is undesirable for the copolymer to be crosslinked so much as to make the copolymer thermosetting.

The divalent acids used as a monomer in the present invention include, for example, phthalic acid, terephthalic acid, fumaric acid, maleic acid, sebacic acid, succinic acid and adipic acid. On the other hand, the divalent alcohols used in the present invention include, for example, aliphatic glycols such as ethylene glycol, propylene glycol, butylene glycol and butene diol, and ethylene oxide adduct and propylene oxide adduct of aromatic bisphenol A.

It is possible to add a natural wax such as rice wax in order to maintain a transparency, to improve the offset resistance and to make it possible to perform fixation without using an oil. The natural waxes used in the present invention should have a low melting point. For example, rice wax has a melting point of about 79° C. Carnauba wax has a melting point of about 83° C. Further, candelilla wax has a melting point of about 71° C. Since each of these natural waxes has a low melt viscosity at 100° C., these waxes are promptly melted by the heat roller to form an oily state so as to improve the offset problem. However, where the melting point is unduly low, and where these natural waxes exhibit endothermic properties at DSC under low temperatures, the storage capability of the toner under high temperatures is impaired. Under the circumstances, it is desirable to use rice wax and carnauba wax. Particularly, it is most desirable to use rice wax in view of the offset resistance.

In the case of using rice wax, the higher fatty acids used as a component of the ester include mainly lignoserine acid, which is a substantially linear saturated fatty acid having 24 carbon atoms, and behenic acid having 22 carbon atoms. On the other hand, the higher alcohols used as the other component of the ester mainly include higher alcohols having an even number of carbon atoms ranging between 24 and 34. It is considered reasonable to understand that higher fatty acids having a relatively narrow range of carbon atoms and a high crystallinity contributes to the improvement in the offset resistance and in the luster. As a matter of fact, higher fatty acid mixture refined to contain at least 60% of lignoserine has been confirmed to further improve the offset resistance. It is desirable to add wax in an amount of 1 to 15% by weight, preferably 2 to 10% by weight. If the wax amount is smaller than 1% by weight, a sufficient effect of preventing the offset problem cannot be obtained. On the other hand, if the wax amount exceeds 15% by weight, the storage capability of the toner under high temperatures is deteriorated. Also, the wax fails to be dispersed uniformly in the toner, with the result that the cleaning properties and the image density (ID) are lowered with time.

In the present invention, it is possible to use as a coloring agent pigments of yellow, magenta, and cyan that are generally used in a colored toner. It is also possible to use various other additives as required in the manufacturing process.

The method for manufacturing the developing agent of the present invention is not particularly limited. In general, a mixture consisting of the polyester resin, the zirconium complex compound of a salicylic acid derivative, the pigments used as the coloring agents, and preferably rice wax, is kneaded uniformly, followed by cooling, pulverizing and, then, classifying the mixture by a jet mill/air classifying machine to obtain toner particles of a desired size. It is advisable to prepare a master batch in advance in order to improve the dispersion capability of the coloring pigments.

Then, hydrophobic silica and titanium oxide are added to the pulverized and classified toner particles, followed by uniformly mixing the resultant mass by, for example, a Henschel mixer to obtain a developing agent of the present invention.

A fixing device that does not include an oil supplying mechanism is used in the present invention. It is desirable to use as the fixing device a heating-pressurizing means equipped with a rubber roller or a tube roller. In this case, it is more desirable to add rice wax to the developing agent.

The present invention will now be described more in detail with reference to Examples that follow.

EXAMPLE 1

A mixture consisting of 96 parts by weight of polyester resin, 3 parts by weight of azo-type magenta pigment and 1 part by weight of "TN-105", which is a trade name of a zirconium complex compound of a salicylic acid derivative used as CCA, represented by a general formula (2) given below, and manufactured by Hodogaya Kagaku K.K., was kneaded by a pressurizing kneader, followed by pulverizing the kneaded mass by a hammer mill to prepare pulverized particles passing through meshes of 2 mm:

(2)

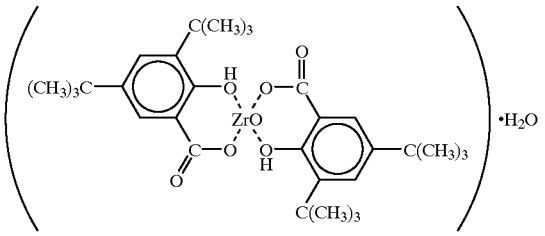

Further, the pulverized particles were finely pulverized by a jet pulverizer, followed by cutting off the fine powder by means of an air classification so as to obtain a magenta toner containing 50% by volume of particles having a particle diameter of 8.0 μm.

Then, 1 part by weight of silica fine powder, i.e., "RX200", which is a trade name of a hydrophobic silica manufactured by Japan Aerosil K.K., and 1 part by weight of "STT-30A", which is a trade name of a titanium oxide fine powder manufactured by Titanium Kogyo K.K., were added to 100 parts by weight of the magenta toner thus prepared, followed by mixing the resultant mass for 3 minutes in a Henschel mixer. Then, the mixture was passed through a sieve of 200 meshes to obtain a two-part negatively charged toner.

The resultant toner was used in "Premarju 251", which is a trade name of a digital copying machine manufactured by Toshiba Corporation, for evaluation of the copied picture image. It was possible to obtain a clean magenta image. The initial ID (IMAGE DENSITY) was found to be 1.85. Also, the charging amount was found to be 4.0 Q/d (femto/C10 μm, measured by an Easpart analyzer manufactured by Hosokawa Micron K.K.). Also, even after a copying test for additional 60,000 copying paper sheets, it was possible to obtain a picture image satisfactory in image density (ID) and free from a fogging problem. Further, toner scattering was scarcely recognized. The charging amount after copying on 60,000 copying paper sheets was found to be 3.8.

The toner was also subjected to a fixing test by using an image forming apparatus including a non-oil type fixing device.

Figure 2:
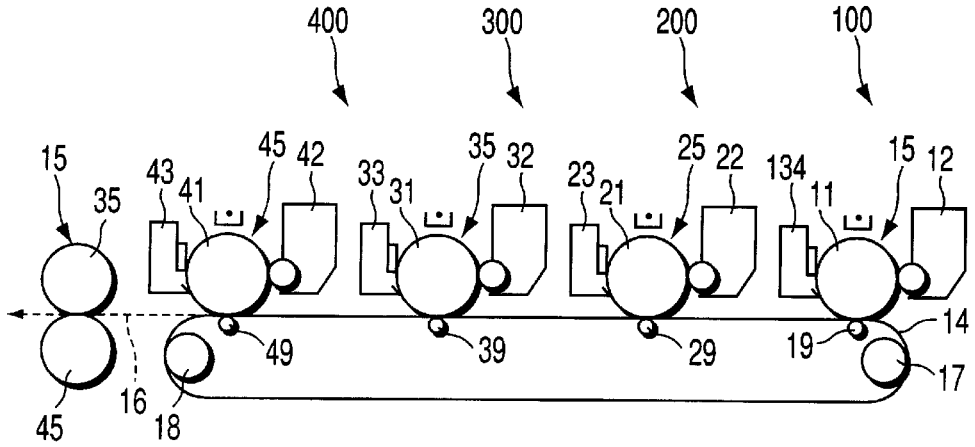
FIG. 2 schematically exemplifies a full color image forming apparatus of the present invention.

FIG. 2 schematically shows an image forming apparatus according to one embodiment of the present invention. As shown in the drawing, the apparatus comprises a photosensitive drum 11, which is a lamination type organic photosensitive body having a diameter of 40 mm and a length of 266 mm. The photosensitive drum 11 is arranged rotatable as denoted by an arrow.

Various devices are arranged around the photosensitive drum 11 in the rotating direction thereof. Specifically, a light exposing section 15 is arranged in the vicinity of the photosensitive drum 11 for exposing the surface of the photosensitive drum 11 charged by a charging roller (not shown) to light to form an electrostatic latent image. Also, a developing device 12 housing a developing agent and serving to develop with the developing agent the electrostatic latent image formed by the light exposing section 15 is arranged downstream of the light exposing section 15. Further, a transfer means 14 for supplying a transfer material to the photosensitive drum 11 is arranged downstream of the developing device 12.

Still further, a blade cleaning device 13 and a destaticizing lamp (not shown) are arranged downstream of the contact point between the photosensitive drum 11 and the a paper sheet (transfer material).

The transfer device 14 has a width substantially equal to that of the photosensitive drum 11 and is in the form of an endless belt. The endless belt is stretched between a tension roller 17 and a driving roller 18. As apparent from the drawing, the endless belt forming the transfer device 14 is in contact with and runs along the outer circumferential surfaces of the tension roller 17 and the driving roller 18. Incidentally, the tension roller 17 and the driving roller 18 are apart from each other by about 300 mm.

Each of the tension roller 17 and the driving roller 18 is rotatable in a direction denoted by the arrow. In accordance with rotation of the driving roller 18, the transfer means 14 is rotated in contact with both the photosensitive drum 11 and the transfer material. The driving roller 18 is rotated in synchronism with rotation of the photosensitive drum 11.

As shown in the drawing, the photosensitive drum 11, the light exposing section 15, the developing device 12, the blade cleaning device 13 and the destaticizing lamp 16 collectively constitute a process unit 100.

Arranged on the transfer means 14 are the process unit 100, another process unit 200, another process unit 300, and a still another process unit 400, which are interposed between the tension roller 17 and the driving roller 18. Each of these process units 200, 300 and 400 is equal in construction to the process unit 100.

To be more specific, photosensitive drums 21, 31 and 41 are arranged in the central regions of the process units 200, 300 and 400, respectively, like the photosensitive drum 11 arranged in the central region of the process unit 100. Also, light exposing sections 24, 35 and 45 are arranged in the vicinity of the photosensitive drums 21, 31 and 41, respectively. Further, developing devices 22, 32, 42 and blade cleaning devices 23, 33, 34 are arranged downstream of the light exposing sections 25, 35, 45, respectively, as in the process unit 100.

However, these process units 100, 200, 300 and 400 differ from each other in the kind of the developing agent housed in the developing device. To be more specific, developing agents of yellow, magenta, cyan and black are housed in the developing devices 12, 22, 32 and 42, respectively. Each of these developing agents contains a coloring material of different color, a binder consisting essentially of a polyester resin, a charge controller consisting of a zirconium complex compound of a salicylic acid derivative, silica subjected to a hydrophobic treatment, and titanium oxide.

In copying a colored image, a copying paper sheet (transfer material) that is transferred by the transfer means 14 is successively brought into contact with the photosensitive drums 11, 21, 31 and 41. Power supply rollers 19, 29, 39 and 49, which constitute transfer means, are arranged at the contact positions between the photosensitive drums 11, 21, 31, 41 and the copying paper sheets, respectively.

For example, the power supply roller 19 is in contact with the back surface of the transfer means 14 at the position where the transfer means abuts against the photosensitive drum 11. Each of these power supply rollers 19, 29, 39 and 49 is connected to a bias power source (not shown). As apparent from the drawing, each of these power supply rollers is rotated in accordance with movement of the transfer means 14.

An image forming process will now be described in respect of the image forming apparatus of the construction described above. Specifically, each of the photosensitive drums 11, 21, 31 and 41, which are rotated, included in the four process units is uniformly charged at 50V by a charging means (not shown) to which is applied an AC-superposed DC bias.

The uniformly charged photosensitive drums 11, 21, 31, 41 are irradiated with light emitted from fluorescent lamps included in the light exposing sections 15, 25, 35, 45, respectively. As a result, electrostatic latent images are formed on these photosensitive drums. These electrostatic latent images are developed with the developing agents of different colors, which are sufficiently charged in advance, in the developing devices 12, 22, 32, 42.

On the other hand, a copying paper sheet (transfer material) is transferred from a paper feeding cassette (not shown) to the transferring position of the photosensitive drum 11. If the copying paper sheet is transferred to the transfer position, a bias voltage of, for example, about 1400V is applied from each of the power supply rollers 19, 29, 39, 49 to the transfer means 14. By application of the bias voltage, a transferring electric field is formed between each of the photosensitive drums 11, 21, 31, 41 and the transfer means 14. As a result, a yellow developing agent is transferred from the photosensitive drum 11 onto the copying paper sheet, and the copying paper sheet carrying the yellow developing agent is transferred to reach the subsequent photosensitive drum 21 bearing a magenta developing agent. Then, the image of the magenta developing agent formed on the photosensitive drum 21 is transferred onto the copying paper sheet having the image of the yellow developing agent formed thereon in advance. Of course, the image of the magenta developing agent is superposed on the image of the yellow developing agent. The copying paper sheet is further transferred to reach the photosensitive drum 31 and, then, the photosensitive drum 41, with the result that the images of the cyan and black developing agents are superposed on the copying paper sheet bearing the images of the yellow and magenta developing agents.

The copying paper sheet bearing the superposed images of the developing agents is transferred from the transfer means 14 into the fixing device 15. The fixing device 15 comprises the heat roller 35 and the pressurizing roller 45. The copying paper sheet is passed through the clearance between the heat roller 35 and the pressurizing roller 45 such that the images of the developing agents formed on the copying paper sheet are brought into contact with the heat roller 35. As a result, the images of the developing agents are thermally fixed to the copying paper sheet.

Figure 3:
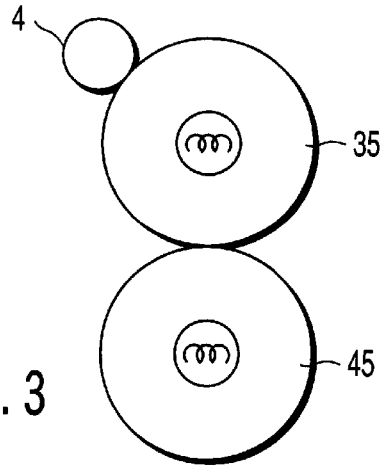
FIG. 3 exemplifies a fixing device included in the full color image forming apparatus of the present invention.

FIG. 3 schematically shows a fixing device used in the image forming apparatus shown in FIG. 2. As shown in the drawing, the fixing device included in the image forming apparatus shown in FIG. 2 is of non-oil type and comprises the heat roller 35, the cleaning roller 4 arranged in contact with the heat roller 35 and the pressurizing roller 45 arranged to face the heat roller 35 and positioned apart from the cleaning roller 4. Also, the fixing device used in the present invention is not equipped with the silicone oil supply means shown in FIG. 1 and including the oil coating roller 101 rotatable in synchronism with rotation of the heat roller 35, the oil impregnation tank 8 equipped with the oil impregnation roller 9 that is rotatable in synchronism with rotation of the oil coating roller 101, the oil transfer pipe 7 equipped with the oil transfer pump 6 and connected to the oil impregnation tank 8, the oil supply tank 5 connected to the oil transfer pipe 7 and housing a silicone oil, the oil recovery filter 102 arranged below the pressurizing roller 45, and another oil transfer pipe 103 connected at one end to the oil recovery filter 102 and at the other end to the oil supply tank 5.

Incidentally, the heat roller 35 consists of, for example, a mandrel having a heater embedded therein and a rubber layer formed on the outer surface of the mandrel. Alternatively, the outer surface of the mandrel having a heater embedded therein is covered with a thin tube made of, for example, PFA or PTFE to form the heat roller 35. The pressurizing roller 45 is substantially equal in construction to the heat roller 35, though it is possible to eliminate the heater embedded in the mandrel. Further, the cleaning roller 4, which serves to remove the toner stain, paper dust, etc. from the outer surface of the heat roller 35, is impregnated with, for example, a silicone oil.

For recognition of the offset problem, the cleaning roller 4 was not impregnated at all with a silicone oil. Also, a PFA tube roller having a diameter of 40 mm was used as each of the heat roller 35 and the pressurizing roller 45. The roller had a hardness of 70°, a nip width of 6 mm. For examining the offset occurrence, images were formed under a load of 55 kgf and a process speed of 127 mm/sec. As a result, a non-offset region was not obtained.

Also, the toner prepared in this Example was put in a polyethylene bag, which was left to stand in a constant temperature bath of 55° C. for 8 hours. After the test, toner agglomeration was scarcely observed, supporting good storage characteristics of the toner under high temperatures.

EXAMPLE 2

A mixture consisting of 91 parts by weight of polyester resin, 5 parts by weight "LAX-N-100A", which is a trade name of rice wax having a melting point of 79° C. and an acid value of 4.7 and manufactured by NS Chemical Kaisha), 3 parts by weight of azo-type magenta pigment and 1 part by weight of "TN-105", which is a trade name of a zirconium complex compound of a salicylic acid derivative used as CCA, represented by the general formula (2) given previously and manufactured by Hodogaya Kagaku K.K., was kneaded by a pressurizing kneader, followed by pulverizing the kneaded mass by a hammer mill to prepare pulverized particles passing through meshes of 2 mm. Further, the pulverized particles were finely pulverized by a jet pulverizer, followed by cutting off the fine powder by means of an air classification so as to obtain a magenta toner containing 50% by volume of particles having a particle diameter of 8.0 $\mu$m.

Then, 1 part by weight of silica fine powder, i.e., "RX200", which is a trade name of a hydrophobic silica manufactured by Japan Aerosil K.K., and 1 part by weight of "STT-30A", which is a trade name of a titanium oxide fine powder manufactured by Titanium Kogyo K.K., were added to 100 parts by weight of the magenta toner thus prepared, followed by mixing the resultant mass for 3 minutes in a Henschel mixer. Then, the mixture was passed through a sieve of 200 meshes to obtain a two-part negatively charged toner.

The resultant toner was used in "Premarju 251", which is a trade name of a digital copying machine manufactured by Toshiba Corporation, for evaluation of the copied picture image. It was possible to obtain a clean magenta image. The initial ID (image density) was found to be 1.80. Also, the charging amount was found to be 4.5. Also, even after a copying test for additional 60,000 copying paper sheets, it was possible to obtain a picture image satisfactory in image density (ID) and free from a fogging problem. Further, toner scattering was scarcely recognized. The charging amount after copying on 60,000 copying paper sheets was found to be 4.3.

The toner was also subjected to a fixing test by using an image forming apparatus including a non-oil type fixing device. As a result, a non-offset region was obtained at 140 to 180° C. Also, a transmittance in the OHP fixation at 160° C. was found to be 75%.

Also, the toner prepared in this Example was put in a polyethylene bag, which was left to stand in a constant temperature bath of 55° C. for 8 hours. After the test, toner agglomeration was scarcely observed, supporting good storage characteristics of the toner under high temperatures.

EXAMPLE 3

A two-part negatively charged toner was prepared as in Example 2, except that the zirconium complex compound of a salicylic acid derivative was added in an amount of 0.5 part by weight.

The resultant toner was used in "Premarju 251", which is a trade name of a digital copying machine manufactured by Toshiba Corporation, for evaluation of the copied picture image. It was possible to obtain a clean magenta image. The initial ID (image density) was found to be 1.82. Also, the charging amount was found to be 4.2. Also, even after a copying test for additional 60,000 copying paper sheets, it was possible to obtain a picture image satisfactory in image density (ID) and free from a fogging problem. Further, toner scattering was scarcely recognized. The charging amount after copying on 60,000 copying paper sheets was found to be 3.6.

The toner was also subjected to a fixing test by using an image forming apparatus including a non-oil type fixing device. As a result, a non-offset region was obtained at 140 to 180° C. Also, a transmittance in the OHP fixation at 160° C. was found to be 75%.

Also, the toner prepared in this Example was put in a polyethylene bag, which was left to stand in a constant temperature bath of 55° C. for 8 hours. After the test, toner agglomeration was scarcely observed, supporting good storage characteristics of the toner under high temperatures.

COMPARATIVE EXAMPLE 1

A toner was prepared as in Example 2, except that "E-84", which is a trade name of a zinc complex compound of a salicylic acid derivative having a chemical structure represented by a general formula (3) given below and manufactured by Orient Chemical Co. Ltd., was used as CCA:

(3)

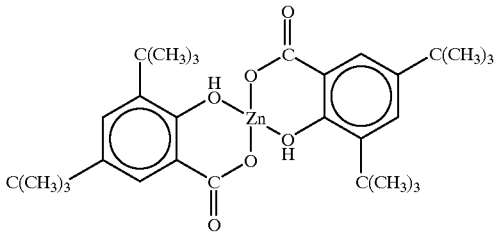

The resultant toner was used in "Premarju 251", which is a trade name of a digital copying machine manufactured by Toshiba Corporation, for evaluation of the copied picture image. It was impossible to obtain a clean magenta image. The initial ID was found to be 1.80. Also, the charging amount was found to be 4.3. Further, an additional copying test was conducted. The charging amount was found to have been lowered to 2.5 when copying was performed on additional 10,000 copying paper sheets. Further, fogging was increased, and toner scattering was also increased.

COMPARATIVE EXAMPLE 2

A toner was prepared as in Example 2, except that "LR-147", which is a trade name of a colorless boron complex compound having a chemical structure represented by a general formula (4) given below and manufactured by Nippon Carlit Inc., was used as CCA:

(4)

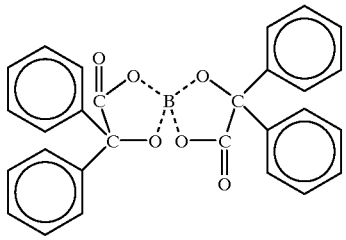

The resultant toner was used in "Premarju 251", which is a trade name of a digital copying machine manufactured by Toshiba Corporation, for evaluation of the copied picture image. It was impossible to obtain a clean magenta image. The initial ID (image density) was found to be 1.83. Also, the charging amount was found to be 4.6. Further, an additional copying test was conducted. The charging amount was found to have been lowered to 2.9 when copying was performed on additional 10,000 copying paper sheets. Further, fogging was increased, and toner scattering was also increased.

COMPARATIVE EXAMPLE 3

A toner was prepared as in Example 2, except that titanium oxide was not added for preparation of the toner.

The resultant toner was used in "Premarju 251", which is a trade name of a digital copying machine manufactured by Toshiba Corporation, for evaluation of the copied picture image. The image density (ID) was found to be low. The initial ID (image density) was found to be 1.50. Also, the charging amount was found to be 5.8. Further, an additional copying test was conducted. The charging amount was found to have been increased to 6.6 when copying was performed on additional 10,000 copying paper sheets. Further, ID (image density) was lowered to 1.28.

COMPARATIVE EXAMPLE 4

A toner was prepared as in Example 2, except that a hydrophobic silica was not added for preparation of the toner.

The resultant toner was used in "Premarju 251", which is a trade name of a digital copying machine manufactured by Toshiba Corporation, for evaluation of the copied picture image. The image density (ID) was found to be sufficiently high. However, fogging was found prominently. Also, the solid copied portion was found to be rough. The initial image density (ID) was found to be 1.90. Also, the charging amount was found to be 3.3. Further, an additional copying test was conducted. The charging amount was found to be 2.9 when copying was performed on additional 60,000 copying paper sheets. Further, fogging and toner scattering were found to have been somewhat increased.

Table 1 shows the experimental data covering Examples 1, 2, 3 and Comparative Examples 1 to 4.

TABLE 1

| | Initial ID | Life ID | Initial Charging Amount | Life Charging Amount | Toner Scattering |
|---|---|---|---|---|---|
| Example 1 | ○ | ○ | 4.0 | 3.8 | ○ |
| Example 2 | ○ | ○ | 4.5 | 4.3 | ○ |
| Example 3 | ○ | ○ | 4.2 | 3.6 | ○ |
| Comparative Example 1 | ○ | ○ | 4.3 | 2.5 | X |
| Comparative Example 2 | ○ | ○ | 4.6 | 2.9 | X |
| Comparative Example 3 | X | X | 5.8 | 6.6 | ○ |
| Comparative Example 4 | ○ | ○ | 3.3 | 2.9 | Δ |

As apparent from Table 1, use of the developing agent of the present invention, it is possible to obtain a satisfactory image density and a good charging amount. Also, toner scattering does not take place. However, in the case of using CCA other than a zirconium complex compound of a salicylic acid derivative as in Comparative Examples 1 and 2, the charging amount is lowered so as to bring about a toner scattering problem. Also, where titanium oxide is not added as in Comparative Example 3, the image density is lowered so as to impair the image quality. Further, if silica is not added as in Comparative Example 4, a sufficient charging amount cannot be obtained, resulting in a toner scattering problem.

It should also be noted that the developing agent prepared in each of Examples 1 and 2 makes it possible to obtain a sufficiently high offset resistance even if the developing agent is used in a fixing device that does not include an oil supply mechanism.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent, comprising a coloring agent, a binder containing a polyester resin as a main component, a charge controller consisting of a zirconium complex compound of a salicylic acid derivative, silica subjected to a hydrophobic treatment, and titanium oxide.

2. A developing agent according to claim 1, further comprising rice wax.

3. A developing agent according to claim 1, wherein said zirconium complex compound of a salicylic acid derivative is added in an amount of 0.2% by weight to 3.0% by weight based on the binder amount.

4. A developing agent according to claim 1, wherein said hydrophobic silica is added in an amount of 0.2% by weight to 3.0% by weight based on the binder amount.

5. A developing agent according to claim 1, wherein said titanium oxide is added in an amount of 0.2% by weight to 3.0% by weight based on the binder amount.

6. An image forming apparatus, comprising an image carrier, a developing device housing a developing agent to develop an electrostatic latent image formed on the surface of said image carrier into a visible image formed of said developing agent, said developing agent comprising a coloring agent, a binder containing a polyester resin as a main component, a charge controller consisting of a zirconium complex compound of a salicylic acid derivative, silica subjected to a hydrophobic treatment, and titanium oxide, a transfer device for transferring said visible image formed of the developing agent onto a transfer material, and a fixing device for fixing the visible image to said transfer material.

7. An image forming apparatus according to claim 6, wherein said fixing device is of non-oil type that is not equipped with an oil supplying mechanism, and comprises a heating-pressurizing means equipped with a rubber roller or a tube roller.

8. An image forming apparatus according to claim 6, wherein said developing agent further comprises rice wax.

9. An image forming apparatus according to claim 6, wherein said zirconium complex compound of a salicylic acid derivative is added in an amount of 0.2% by weight to 3.0% by weight based on the binder amount.

10. An image forming apparatus according to claim 6, wherein said hydrophobic silica is added in an amount of 0.2% by weight to 3.0% by weight based on the binder amount.

11. An image forming apparatus according to claim 6, wherein said titanium oxide is added in an amount of 0.2% by weight to 3.0% by weight based on the binder amount.

12. An image forming apparatus, comprising a first image carrier, a first developing device housing a first developing agent to develop a first electrostatic latent image formed on the surface of said first image carrier into a first visible image formed of said first developing agent comprising a first color agent, a binder containing a polyester resin as a main component, a charge controller consisting of a zirconium complex compound of a salicylic acid derivative, silica subjected to a hydrophobic treatment, and titanium oxide;

a second image carrier, a second developing device housing a second developing agent to develop a second electrostatic latent image formed on the surface of said second image carrier into a second visible image formed of said second developing agent comprising a second color agent, a binder containing a polyester resin as a main component, a charge controller consisting of a zirconium complex compound of a salicylic acid derivative, silica subjected to a hydrophobic treatment, and titanium oxide;

and fixing device fixing the first and second visible image to a transfer material.

13. An image forming apparatus according to claim 12, wherein said fixing device is of non-oil type that is not equipped with an oil supplying mechanism, and comprises a heating-pressurizing means equipped with a rubber roller or a tube roller.

14. An image forming apparatus according to claim 12, wherein said first and second developing agent further comprises rice wax.

15. An image forming apparatus according to claim 12, wherein said zirconium complex compound of a salicylic acid derivative is added in an amount of 0.2% by weight to 3.0% by weight based on the binder amount.

16. An image forming apparatus according to claim 12, wherein said hydrophobic silica is added in an amount of 0.2% by weight to 3.0% by weight based on the binder amount.

17. An image forming apparatus according to claim 12, wherein said titanium oxide is added in an amount of 0.2% by weight to 3.0% by weight based on the binder amount.

* * * * *